United States Patent [19]

Vico

[11] Patent Number: 4,793,079

[45] Date of Patent: Dec. 27, 1988

[54] PROCESS FOR THE MANUFACTURING OF FOOTWEAR AND FOOTWEAR OBTAINED THROUGH THIS PROCESS

[75] Inventor: Fernando Vico, Monte San Giusto, Italy

[73] Assignee: Max dei F. 11I Vico & C. S.p.A., Italy

[21] Appl. No.: 47,426

[22] Filed: May 6, 1987

[30] Foreign Application Priority Data

Oct. 17, 1986 [IT] Italy ..... 3546 A/86
Jan. 16, 1987 [IT] Italy ..... 3319 A/87

[51] Int. Cl.[4] ..... A43B 03/14; A43B 13/12

[52] U.S. Cl. ..... 12/142 MC; 12/142 T; 36/11; 36/12

[58] Field of Search ..... 12/142 RS, 142 T, 142 MC, 12/142 B, 142 C, 142 D; 36/12, 11, 17, 18, 19, 19.5, 14

[56] References Cited

U.S. PATENT DOCUMENTS

| | | | |
|---|---|---|---|
| 790,558 | 5/1905 | Butterfield | 36/14 |
| 1,871,763 | 8/1932 | Wiggin | 36/11 |
| 1,918,946 | 7/1933 | White | 12/142 MC |
| 2,412,051 | 12/1946 | Lee | 36/11 |
| 2,826,770 | 3/1958 | Freeman | 12/142 MC |
| 3,327,334 | 6/1967 | Wilmanns et al. | 12/146 B |
| 3,806,974 | 4/1974 | DiPaozo | 12/142 RS |
| 4,176,476 | 12/1979 | Hassell | 36/14 |
| 4,530,462 | 11/1985 | Phillips | 12/142 T |

FOREIGN PATENT DOCUMENTS

| | | | |
|---|---|---|---|
| 1117291 | 5/1956 | France | 36/11 |
| 1361376 | 4/1964 | France | 12/142 MC |
| 0026944 | 2/1977 | Japan | 12/142 RS |
| 2137638 | 10/1984 | United Kingdom | 36/12 |

*Primary Examiner*—Steven N. Meyers
*Attorney, Agent, or Firm*—Darby & Darby

[57] ABSTRACT

The process firstly involves the making of a sole and a vamp. The sole is composed of two elements, respectively upper and lower, that can be joined together as a perfect fit. The vamp, includes a rear area, a toe cap and of other completing parts. Subsequently the vamp is superimposed upon the upper sole element and sewn to the latter. Then the upper and lower sole elements are joined together by gluing. Finally the vamp is folded upwards and the rear area, the toe cap and the completing parts are sewn to it.

6 Claims, 6 Drawing Sheets

Fig. 1
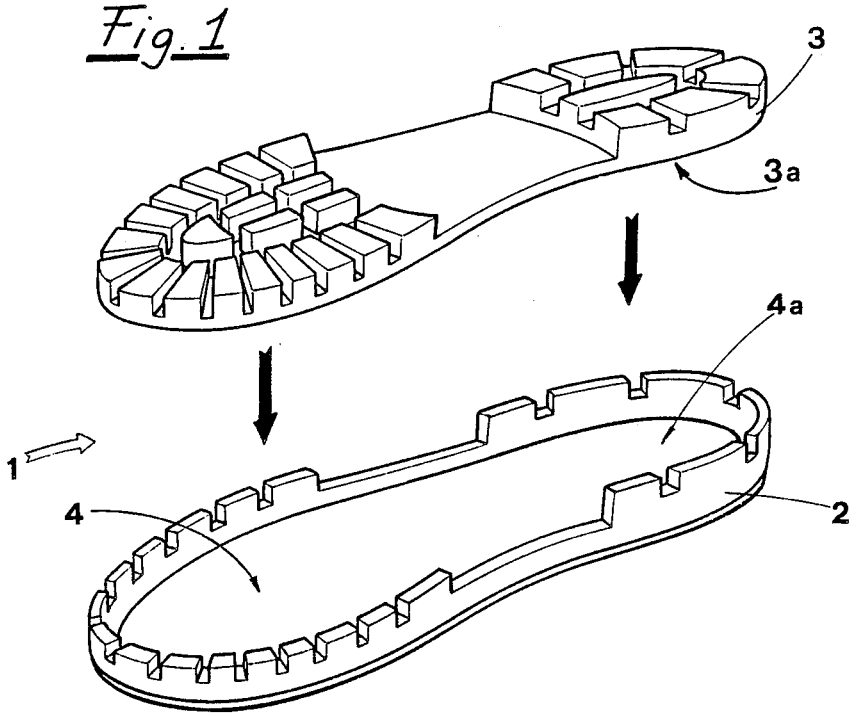
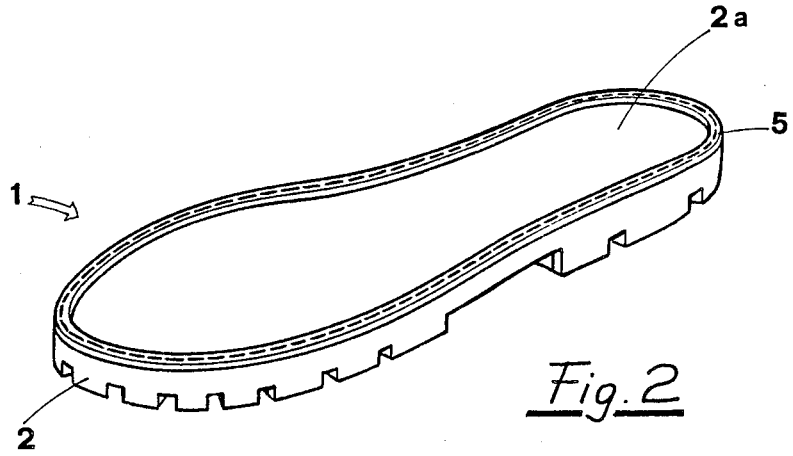
Fig. 2

PROCESS FOR THE MANUFACTURING OF FOOTWEAR AND FOOTWEAR OBTAINED THROUGH THIS PROCESS

BACKGROUND OF THE INVENTION

The present invention relates to the field of the industrial production of footwear and more particularly to a process for the manufacturing of footwear and footwear obtained through this process.

DESCRIPTION OF THE PRIOR ART

It is well-known that footwear of the so called "moccasin" type or anyway footwear of a sporting type, generally made of soft skin, is composed of a sole, of flexible type for example, to which the lower part of an element called the vamp is joined, and of other completing parts having the purpose of reinforcement, decoration, etc.

The vamp has the bottom opened or closed (as in the case of the tubular moccasin) and is closed above by a toe cap and to the rear by a rear piece.

The process for the industrial manufacture of this footwear is at the present time carried out to successive stages as described below.

First of all the sole is made, along the whole external edge of which there is a raised border having a decorative purpose.

Following this the obtaining of a vamp is foreseen, of a toe cap and of other elements completing the footwear.

In a subsequent stage the rear part of the vamp is closed and sewn and to this rear part an element completing the footwear is applied, this too by means of sewing.

The front part of the vamp is shaped and folded upwards and to this the toe cap is sewn.

At this point a heated shoe tree is temporarily introduced into the vamp for the purpose of softening the skin and of stretching the vamp itself.

After the shoe tree has been slipped out, the next stage is for a second shoe tree to be inserted into the vamp, the task of which is to keep the vamp well stretched.

On the bottom of the second shoe tree other parts have been fixed, through known techniques, in order to close the bottom of the vamp itself. The external lower surface of the vamp, subsequently destined to be fixed by gluing to the upper surface of the sole is then scraped, by means of abrasive material, in order to make it rough and to optimize the grip of the glue on it. This last operation must be carried out by particularly expert personnel, as the zone concerned must necessarily coincide with the area delimited on the vamp by the corresponding perimeter of the sole.

Should, in fact, this zone not be sufficiently extensive the vamp could separate from the sole in those zones which undergo gluing but not scraping.

If, on the other hand, this zone is too large, extending beyond the abovementioned ideal area, there will be unsightly marking of some zones of the vamp.

In both cases there would be considerable aesthetic and functional drawbacks.

Subsequently a layer of glue is applied to the scraped surface of the vamp which should then be placed in a position to adhere to the upper surface of the sole.

Normally this last operation is performed in two successive stages.

In a first stage a layer of glue, which is not active, is applied to the scraped surface of the vamp that can therefore remain in the environment in which the manufacturing of the footwear is carried out, even for long periods, without the glue drying up.

In a second stage the vamp is placed in an oven at a prefixed temperature in order to provoke the activation of the glue.

In a later stage the vamp, with the shoe tree still inserted in it, is arranged with the lower surface, scraped and with glue on it, in adhesion with the upper surface of the sole, and at the same time under a prefixed pressure in order to enable good grip to the glue.

Finally, when the glue has dried, the shoe tree is slipped out of the vamp and the footwear undergoes finishing operations, such as, for example, the sewing of further decorative parts to the vamp.

According to a variation of the abovementioned known process, before the insertion of the second shoe tree in the vamp, the lower part of the latter is closed by means of an intermediary sole, which is sewn to the vamp, made in a material having a rough surface.

This makes it possible to avoid having to scrape the vamp.

A further process, this also well known, differs from the one which has just been described by the fact that it involves the sewing of the vamp (already completed to define the upper part of the footwear) to the sole, sewing that is carried out along a suitable groove following the border of the edge of the sole, on the lower face of the latter.

Footwear produced using this last process has, however, the disadvantage that, as the sole wears with the passing of time, the seam does not remain protected inside the groove for very long and it wears out by rubbing on the ground, thus compromising the joint between the sole and the vamp.

Furthermore, it is obvious that a high number of operations are necessary in the well know processes described above.

These operations, furthermore, do not lend themselves very much to automation, above all regarding the scraping of the vamp, and require the large scale employment of skilled personnel.

All of this has a negative effect on the production cost of the footwear, a cost which should, on the other hand, be kept low as possible, whilst at the same time, obtaining increasingly improved product quality.

SUMMARY OF THE INVENTION

The purpose of the present invention is to propose a process for the production of footwear which can be carried out in a lower number of operations, compared to the processes carried out up to date, giving however, a result that is not inferior to the quality of the footwear produced at the present moment as regards to the quality of the finished product.

Another purpose of the present invention is to propose a process the operations in which may be effected using automatic machines more easily and profitably than previously effected processes.

The abovementioned purposes are achieved through a process for the manufacturing of footwear made up of a sole to which the lower part of a vamp is fixed, this latter being closed on the upper part by means of a toe cap and on the rear part by means of a rear area, and of other completing parts; said process including the following stages: production of said sole made up of at least two separate elements upper and lower respectively, that fit together perfectly; production of said vamp, including the aforesaid rear area, as an integral part of it, for the closing of said vamp, as well as the production of the aforesaid toe cap and of the other above-mentioned completing parts; superimposing and fixing of the central portion of the aforesaid vamp, lying flat, in relation to the upper face of said upper element; application of a layer of glue to the upper face of said lower element and on the lower face of said upper element; placement in an oven, for a predetermined length of time at a predetermined temperature, of the aforesaid lower element and upper element, with the aforementioned vamp fixed to this latter; joining together said lower element and upper element; folding upwards of the parts of said vamp that stick out sideways from said sole and sewing of the aforesaid rear area as well as of the other aforementioned parts to said vamp; closing of the upper part of the above-mentioned vamp through sewing said toe cap to this latter.

BRIEF DESCRIPTION OF THE DRAWINGS

The features of the invention, which do not emerge from the description above, are emphasized in the following description, with particular reference to the enclosed drawings, in which:

FIG. 1 illustrates in a perspective view the two elements composing the sole, detached one from the other and turned upside down;

FIG. 2 illustrates in a perspective view the upper element of the sole;

DESCRIPTION OF THE PREFERRED EMBODIMENT

Figure 3:
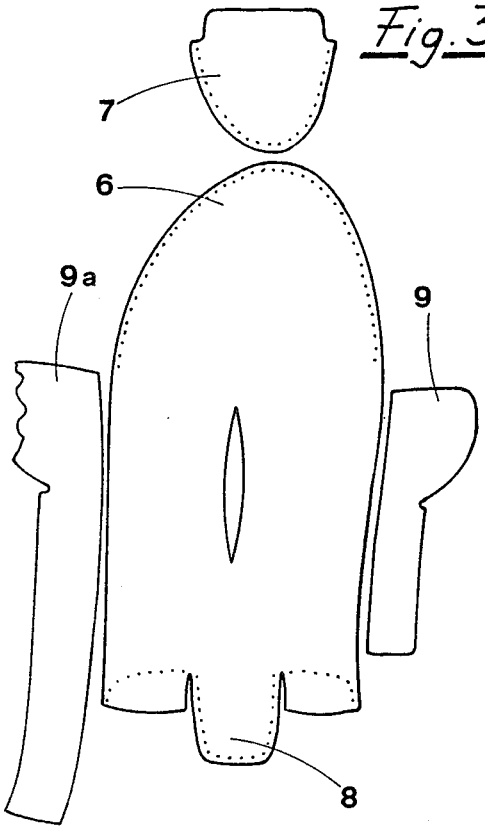
FIG. 3 illustrates a vamp, in a flat configuration, a toe cap and other parts completing the footwear.

With reference to the abovementioned figures, 1 shows a sole composed of two elements respectively upper 2 and lower 3 (illustrated overturned in FIG. 1).

The upper element 2 has a raised border 5 along the edges of its upper face 2*a* which is made up of a strip of leather glued along the same edge and which bears a seam along its whole length as illustrated in FIG. 2.

The raised border 5 has a solely decorative purpose and can, alternatively, be made as an integral part of the upper element.

The upper element 2, on the other hand, features a recess 4 in its lower face 4*a*, into which the lower element 3 may be inserted as a perfect fit.

The obtaining of the two elements 2 and 3 represents a first stage in the process which is the subject of the present invention.

A second phase in the process involves producing, from a skin, a vamp 6, a toe cap 7, and other completing parts 9*a* and 9*b* that complete the footwear.

The vamp 6 is shaped, as illustrated in FIG. 3, in such a way as to include a rear area 8 at the back for the rear closure of the vamp.

In a third stage of the process the vamp is laid flat with its central part adhering to the upper face 2*a* of the upper element 2, and fixed to the latter by sewing.

Figure 4:
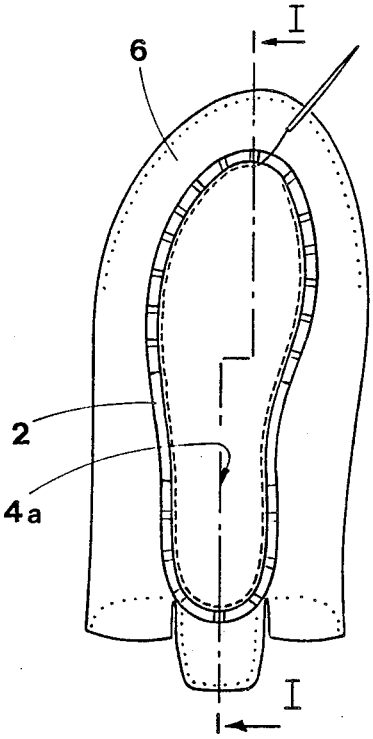
FIG. 4 illustrates the stage of sewing the vamp to the upper element of the sole.

The stitching, as shown in FIG. 4, follows a line running along the inner perimeter of the raised border 5, and the lateral walls marking the boundaries of the recess 4.

This is followed by a fourth stage during which a layer of glue is applied over the entirety of the upper face of the lower element 3, and of the lower face 4*a* of upper element 2.

The two elements can at this point be stored, or else undergo the subsequent manufacturing stages in such a way that the flow of the product is adjusted to the requirements of the production line.

The process involves the use of glue (of known type) the activation of which is obtained by passing it through an oven at a predetermined temperature.

Figure 5A:
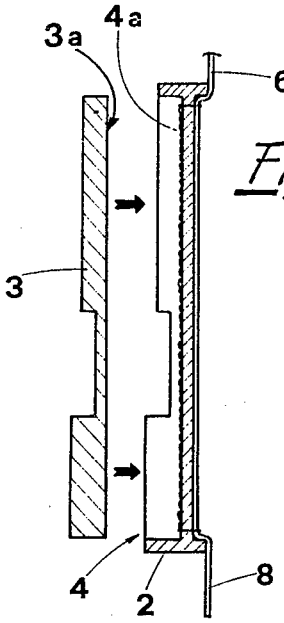
FIGS. 5 and 5*a* illustrate the stage in which the two elements making up the sole are joined together, respectively from above and in lateral cross section I—I of FIG. 4.
Figure 5:
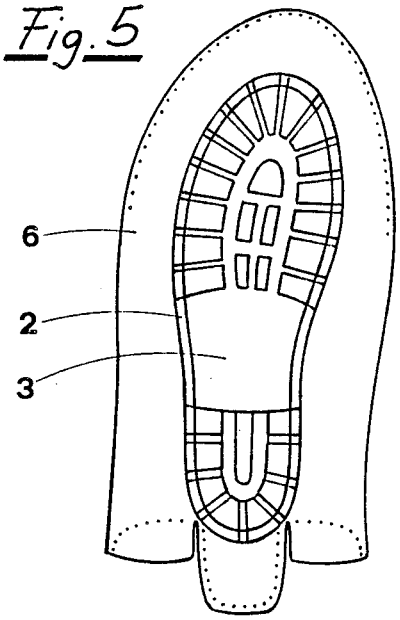

For the purpose therefore of activating the glue the two elements making up the sole are passed through an oven, and the faces of the two elements to which the glue has been applied are subsequently made to adhere to one another under a preset pressure, in such a way that the lower element 3 is inserted in the recess 4 of the upper element 2, as illustrated in FIGS. 5 and 5*a*.

Figure 6:
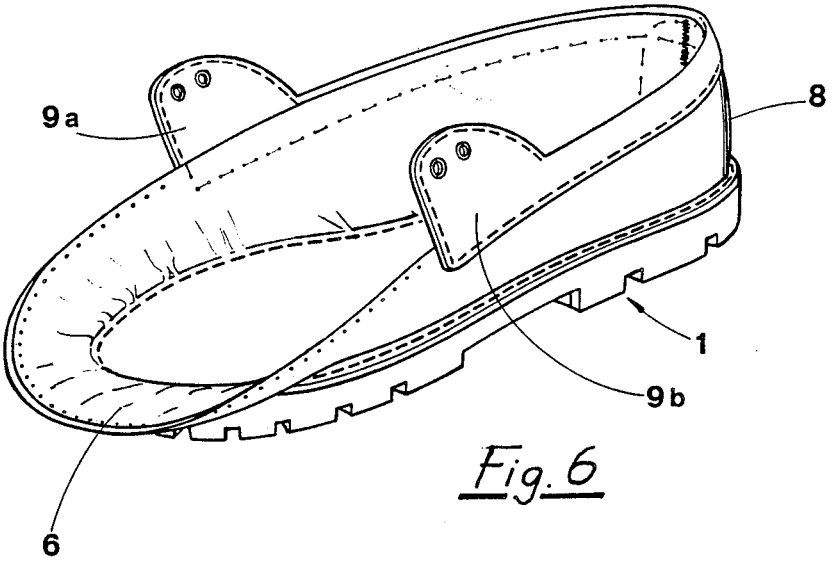
FIGS. 6 and 7 illustrate the footwear obtained with the present process in the finishing stage and completed stage respectively.
Figure 7:
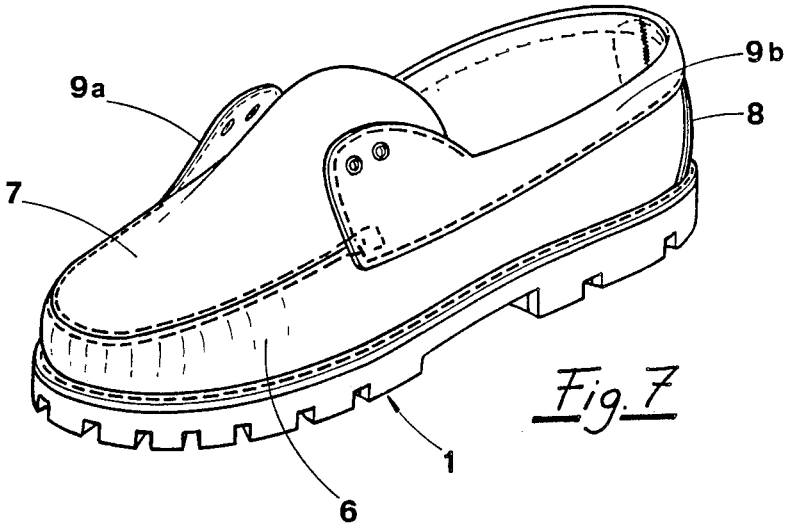

A fifth stage of the process involves folding upwards the parts of the vamp jutting out from element 2 and of the rear area 8, as well as sewing the latter and the completing parts 9*a* and 9*b* to the vamp, as illustrated in FIG. 6.

A last stage, finally, involves the closing of the vamp 6 through the sewing of its foremost part to the toe cap 7.

Further finishing stages, for example the stretching of the vamp, follow the abovementioned stages of the process which is the subject of the present invention, as for the processes known at the present time.

The two elements of the sole, respectively upper and lower, can be made up in accordance with a second embodiment, without involving substantial modifications to the process described above.

Figure 8:
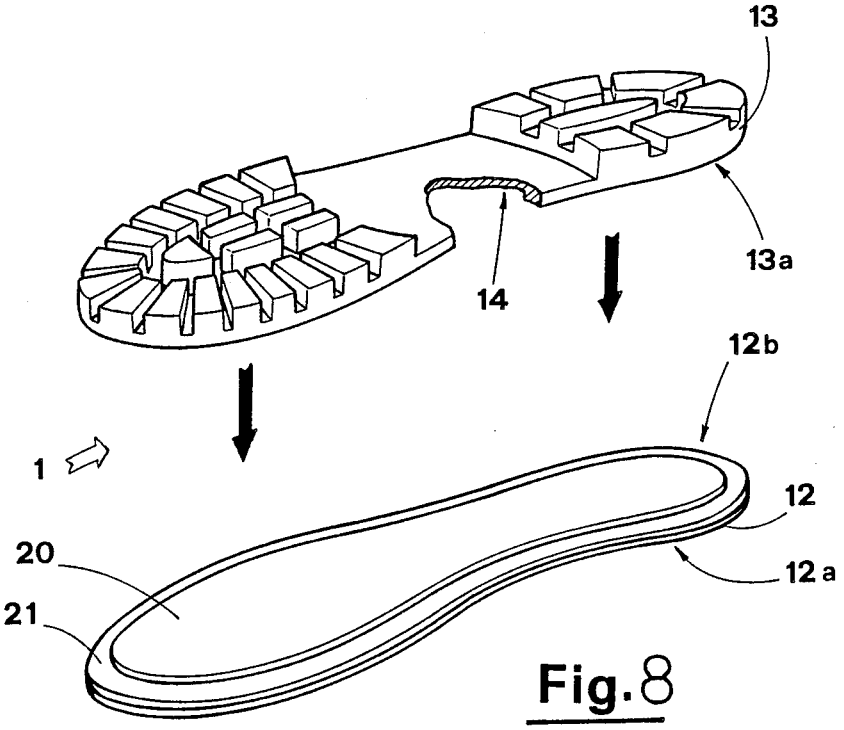
FIG. 8 illustrates in a perspective view the two elements composing the sole, detached from one another and turned upside down, for the manufacturing of the footwear according to a second embodiment.
Figure 9:
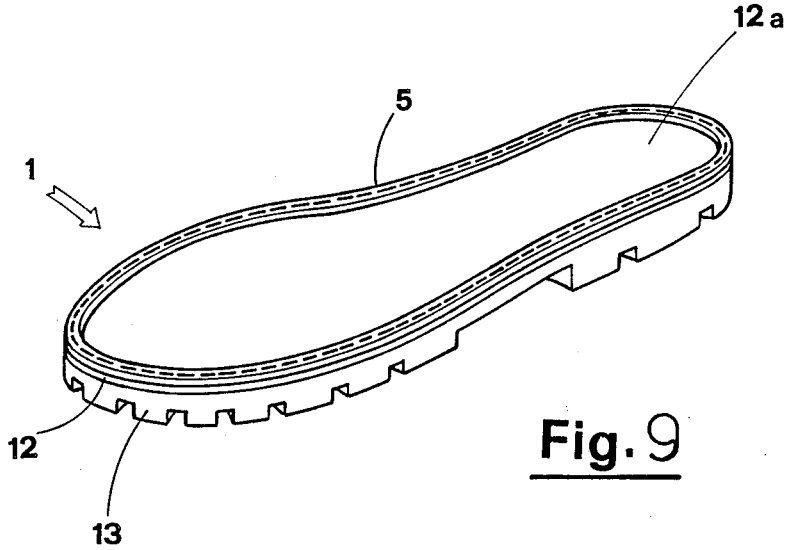
FIG. 9 illustrates in a perspective view the two elements shown in FIG. 8 joined to one another.

With reference to the FIGS. 8–14, the sole 1, is composed of two elements respectively upper 12 and lower 13 (illustrated overturned in FIG. 8).

A raised portion 20 is produced in the lower face 12*b* of the upper element 12 using a known technique, extending over almost the entire face 12*b*, leaving free only an edge 21, which follows round the entire perimeter of element 12.

The raised portion 20 can, for example, be composed of a different material from that of element 12, and be glued to the latter.

The function of the raised portion 20 will be explained below.

The upper element 12 also has a raised border 5 as in the embodiment described above.

The lower element 13, on the other hand, features a recess 14 in its upper face 13*a*, into which the raised portion 20 of the upper element 12 may be inserted as a perfect fit.

Figure 10:
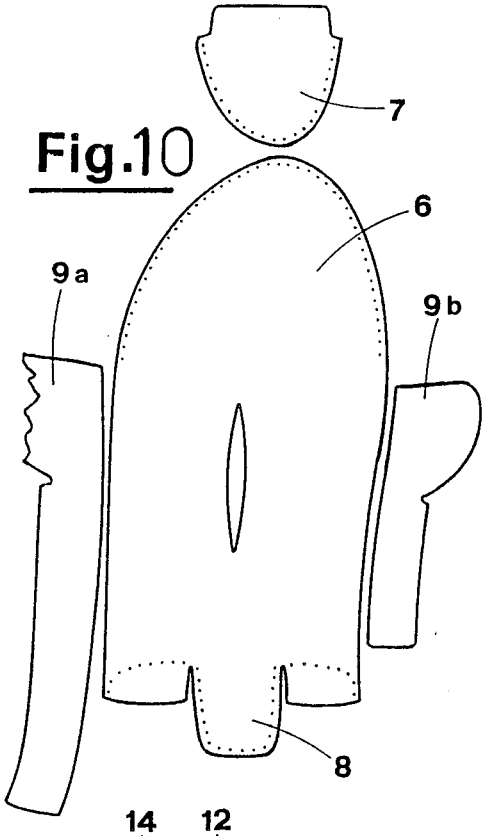
FIG. 10 illustrates a vamp, in a flat configuration, a toe cap and other completing parts that make up the footwear according to the said second embodiment.

The second stage in the process involves producing from a skin, a vamp 6, a toe cap 7, and other completing parts 9*a* and 9*b* that complete the footwear, as shown in FIG. 10.

As in the former embodiment, during a third stage of the process the vamp is laid flat with its central part adhering to the upper face 12*a* of the upper element 12, and fixed to the latter by sewing.

Figure 11:
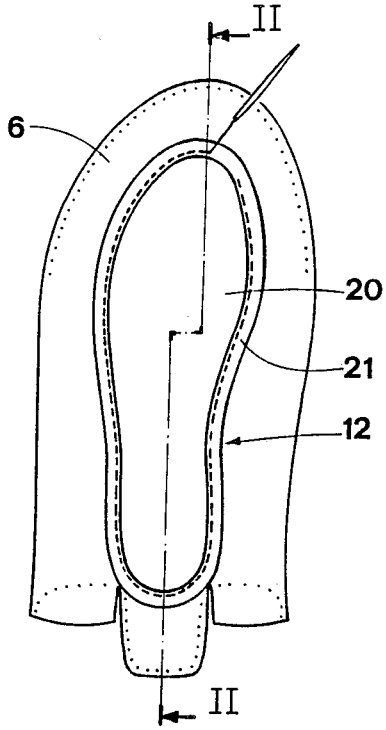
FIG. 11 illustrates the stage of sewing the vamp to the upper element of the sole of FIG. 8.

The stitching, as shown in FIG. 11, follows the angle formed by the side running along the perimeter of the raised portion 20 and the free edge 21 of element 12.

This is followed by a fourth stage during which a layer of glue is applied over the entirety of the upper face 13*a* of lower element 13, and of the lower face 12*b* of upper element 12.

The two elements can at this point be stored, or else undergo the subsequent manufacturing stages.

Figure 12A:
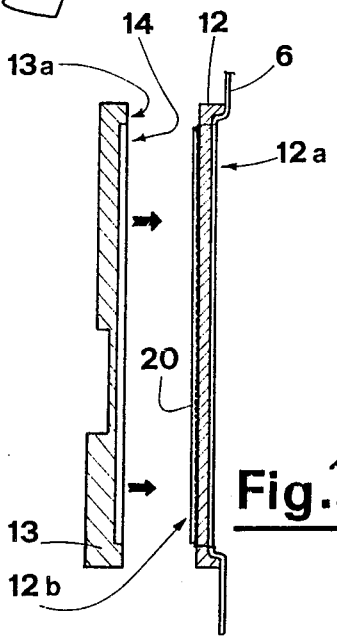
FIGS. 12 and 12*a* illustrate the stage in which the two elements of FIG. 8 are joined together, respectively from above and in lateral crosssection II—II of FIG. 11.
Figure 12:
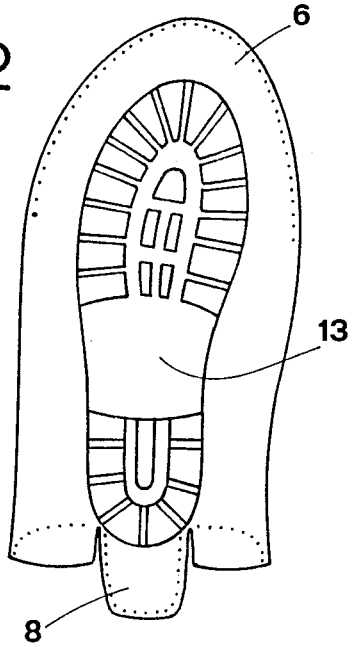

The two elements making up the sole are then passed through an oven, and the faces of the two elements to which the glue has been applied are subsequently made to adhere to one another under a preset pressure, taking care that the raised portion 20, on the face 12*b* of element 12, stays inserted within recess 14, as illustrated in FIGS. 12 and 12*a*.

Figure 13:
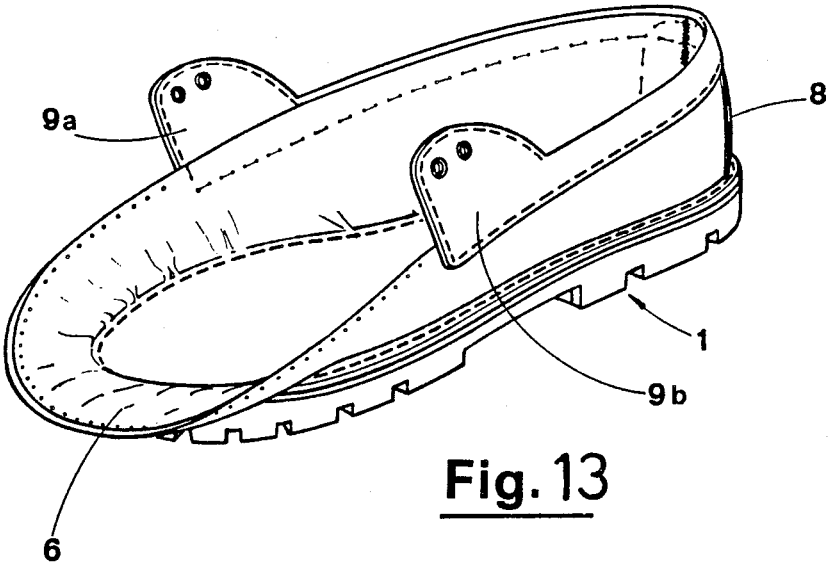
FIGS. 13 and 14 illustrate the footwear obtained according to the said second embodiment in the finishing stage and completed stage respectively.
Figure 14:
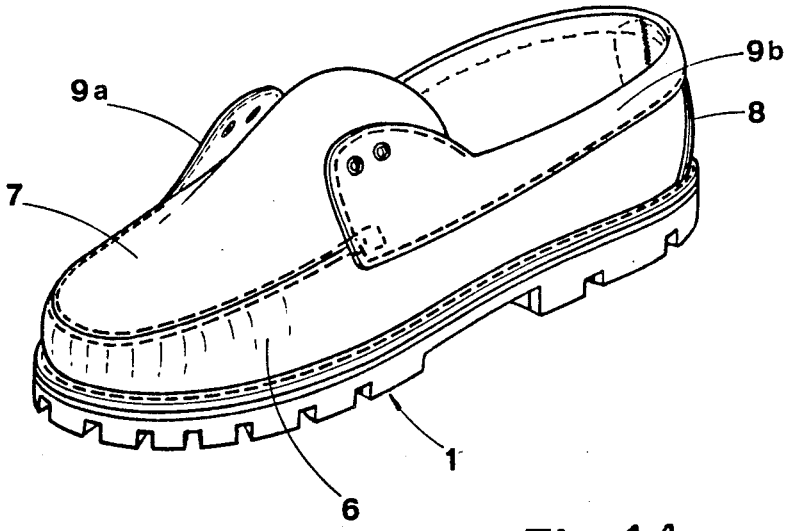

A fifth stage in the process involves folding upwards the parts of the vamp jutting out from element 12 and of the rear area 8, as well as sewing the latter to the vamp, as illustrated in FIG. 13.

A last stage, finally, involves the closing of the vamp 6 through the sewing of its foremost part to the toe cap 7.

Further finishing phases, for example the stretching of the vamp, follow the abovementioned stages of the process as in the former case.

The application of glue to the faces 3*a* and 4*a* or 13*a* and 12*b* as well as the joining together of the two elements 2 and 3, or 12 and 13, can be made, in a stage that follows the closing of the vamp 6 with the toe cap 7, as a variation on that stated above.

This variation allows keeping, during all the previous manufacturing stages, the maximum flexibility of the upper element 2 or 12, facilitating the execution of the operations themselves.

It is obvious that, in comparison with the known process described in the intorductory statement, by carrying out the process that is the subject of the present invention, a significant reduction in the number of the operations is obtained.

Besides, the process proposed herein lends itself to being carried out in an easier way and more conveniently by means of automatic machines, not requiring the use of large numbers of particularly skilled personnel.

This allows one to effect a considerable reduction in the production costs of footwear obtained using the present process, without compromising the quality, but, indeed, improving it.

Furthermore, the seam between vamp and sole on face 4*a* or 12*b*, inside the recess 4 or 14, is always protected by the whole lower element 3 or 13 and cannot be affected by external agents not even as a consequence of the wear of the sole.

The fact that the above-mentioned seam remains intact with the passing of the time is an extremely important advantage, since it is sufficient for such a seam be broken at any one of its stitches for the entire seam to be compromised, due to its particular conformation.

The centering of the vamp with regard to the upper element 2 or 12 can be assured more effectively, during the stage in which the vamp is sewn to this latter element, by means of previous temporary gluing, that, moreover, contributes to optimizing the connection between these last two components of the footwear.

The positioning of the vamp with regard to the sole can be made easier and more sicure through the production of some raised parts in the central zones of the surfaces 2*a* or 12*a*, that are later inserted into corresponding cavities executed in the vamp.

In a further modification of the present process, the the vamp 6 is, even in a flat position, joined to the upper element 2 or 12 solely by a definitive gluing, obvioiusly of greater effectiveness.

It should, finally, be pointed out that the process may also be employed in the production of other types of footwear of similar construction.

It is to be understood that what has been described above has been described by way of an example and is not restrictive, therefore any possible modifications of a practical or applicative nature do not invalidate the protection of the present invention, as described above and claimed as follows.

What is claimed is:

1. Footwear including:

a sole made up of at least two separable elements, a first sole element and a second sole element, each of said first and second sole elements having an upper face and a lower face, said upper face of said second sole element having a recess, said lower face of said first sole element having a raised portion, said raised portion having a shape corresponding to said recess, said raised portion being located in the recess of said second sole element, said raised portion being attached to said recess by a thermo adhesive placed on said raised portion and said recess;

a one-piece vamp having an upper part, a rear area which closes said vamp at its rear, and a central portion which is attached to said upper face of said first sole element;

a toe cap attached to said vamp at its upper part, and closing it in the front of said footwear; and at least two strips attached to the upper part of the vamp along its sides to complete said footwear.

2. Footwear including:

a sole made up of at least two separable elements, a first sole element and a second sole element, each of said first and second sole elements having an upper face and a lower face, said lower face of first sole element having a recess, said second sole element having a shape corresponding to the recess, said second sole element being locked in the recess of said first sole element, said second sole element being attached to said recess by a thermo adhesive placed on the upper face of said second sole element and said recess of said first sole element;

a one-piece vamp having an upper part, a rear area which closes said vamp at its rear, and a central portion which is attached to said upper face of said first sole element;

a toe cap attached to said vamp at its upper part and closing it in the front of said footwear; and at least two strips attached to the upper part of the vamp along its sides to complete said footwear.

3. A process for manufacturing of footwear, said process including the following steps:

forming a first sole element having two faces, an upper face and a lower face, said lower face of said first element having a recess;

forming a second sole element having two faces, an upper face and a lower face, said upper face of said second element being formed to correspond to said recess such that it fits within and mates with said recess of said first element;

forming a toe cap and at least two strips;

forming a one-piece vamp having a rear area, an upper part, and a central portion;

superimposing said central portion of said vamp, while lying flat, on said upper face of said first sole element and sewing it thereto;

applying a layer of glue on said upper face of said second sole element and a layer of glue on said lower face of said first element;

heating said first and second sole elements for a predetermined period of time at a predetermined temperature;

inserting said second sole element into said recess of said first sole element so that said first element and said second element are glued together;

folding up said upper part of said vamp and sewing said rear area to close the rear area as well as sewing said strips to said vamp; and sewing said toe cap to said upper part of said vamp so as to close the upper part of said vamp.

4. A process for manufacturing of footwear, said process including the following steps:

forming a first sole element having two faces, an upper face and a lower face, said lower face of said first sole element having a raised portion;

forming a second sole element having two faces, an upper face and a lower face, said uppe face of said second sole element having a recess being formed to correspond to said raised portion such that said raised portion fits within and mates with said recess of second sole element;

forming a toe cap and at least two strips;

forming a one-piece vamp having a rear area, an upper part, and a central portion;

superimposing said central portion of said vamp, while lying flat, on said upper face of said first sole element and sewing it thereto;

applying a layer of glue on said lower face of said first element and a layer of glue on said upper face of said second element;

heating said first and second sole elements for a predetermined period of time at a predetermined temperature;

inserting said raised portion of said lower face of said first sole element into said recess of said second sole element so that said first element and said second element are glued together;

folding up said upper part of said vamp and sewing said rear area to close the rear area as well as sewing said strips to said vamp; and sewing said toe cap to said upper part of said vamp so as to close the upper part of said vamp.

5. A process as in claim 3 or 4 including the additional step of forming a raised border along a peripheral edge of said upper face of said first sole element during the step of forming said first sole element.

6. A process as in claim 5, wherein the raised border is one-piece with said first sole element.

* * * * *